United States Patent [19]

Kerwit

[11] 4,038,709

[45] Aug. 2, 1977

[54] DUAL HYDRAULIC HOSPITAL BED

[75] Inventor: Malcolm Kerwit, Edison, N.J.

[73] Assignee: Kerwit Medical Products, Inc., Edison, N.J.

[21] Appl. No.: 643,947

[22] Filed: Dec. 24, 1975

[51] Int. Cl.[2] ..... A61G 7/10; A47C 3/32

[52] U.S. Cl. ..... 5/68; 5/66

[58] Field of Search ..... 5/63, 66–68, 5/81

[56] References Cited

U.S. PATENT DOCUMENTS

| | | | |
|---|---|---|---|
| 2,625,839 | 1/1953 | Cokman | 5/69 |
| 3,191,195 | 6/1965 | Schlackman et al. | 5/63 |
| 3,304,116 | 2/1967 | Stryker | 5/81 R |
| 3,503,082 | 3/1970 | Kerwit | 5/67 |
| 3,584,321 | 6/1971 | Buchanan | 5/68 |
| 3,717,885 | 2/1973 | De Mare | 5/61 |
| 3,724,004 | 4/1973 | Behrens | 5/68 |

*Primary Examiner*—Casmir A. Nunberg
*Attorney, Agent, or Firm*—Morgan, Finnegan, Pine, Foley & Lee

[57] ABSTRACT

An improved dual hydraulic hospital bed having hydraulically actuated support means for controlling the movement of the bed frame. A dual mode hydraulic pump actuates the support means and controls the movement of additional hydraulic means to control the position of the bed frame and a support frame and thus the position of the upper body and legs of a patient. The dual mode hydraulic pump is driven by a foot petal or compressed air from a compressed air source, such as the compressed air wall outlets found in most hospital rooms. Preferably, the improved dual hydraulic hospital bed includes a bidirectional spring loaded cassette holder for positioning an X-ray cassette below any of the radiolucent panels affixed to the supporting frame to facilitate the taking of X-rays.

9 Claims, 8 Drawing Figures

DUAL HYDRAULIC HOSPITAL BED

Various hospital bed constructions have been proposed for the care of critically ill patients. Generally, all such hospital beds are mechanically or hydraulically actuated since electrically actuated hospital beds are undesirable due to the potential shock hazard to a patient.

U.S. Pat. No. 3,503,082 (Kerwit) represents a significant advance in hospital beds for the care of the critically ill by providing a radiolucent hospital bed construction. The backround of conventional hospital beds and the need for and advantages of the radiolucent hospital bed are fully discussed therein and should be consulted for background information which provides a greater understanding of the present invention. However, it has been found that when utilizing a hydraulically actuated hospital bed having a construction similar to the preferred embodiment shown in the aforementioned patent and which is actuated solely by a foot pedal, the foot power required to actuate the foot pump is less than totally satisfactory due to the excessive amount of stength required to activate the pump and the excessive amount of strokes required to obtain a desired bed position.

The present invention is directed to providing an improved hospital bed and more specifically to an improved dual hospital bed having a dual mode pump which, in addition to being actuated by a foot pedal for emergencies, when the bed is in transit, or when the bed is in a location having no compressed air source, can also be actuated by a supply of compressed air which is usually present in the wall outlet of most hospital rooms.

U.S. Pat. No. 3,781,928 (Swallert) discloses a bed having a hydraulic pump actuated by an electrical motor or a source of compressed air to inflate air bags to control the movement of the head and foot ends of a mattress and its supporting frame. This bed does not have a dual mode hydaulic system and the bed frame is not movable relative to the floor. Clearly the bed construction does not meet the criteria need for hospital beds. Specifically, the Kneeflex position and the high position are not attainable with this construction.

U.S. Pat. No. 3,530,514 (McCalley) discloses an adjustable hospital bed controlled by a plurality of air motors or jacks which adjust the position of the mattress in accordance with a patient's movement. The air motors or jacks do not have a dual hydraulic mode of operation. Moreover, this construction does not lock the patient in a preselected position, but rather responds to the patient's movement, which is an undesirable characteristic for hospital beds to bed used in the care of patients.

It is an object of the present invention to provide a hospital bed for the care of the critically ill patient which overcomes the deficiencies of known hospital bed constructions.

It is a further object of the present invention to provide a hospital bed for the care of the critically ill patient having a dual hydraulic mode of operation, enabling the bed to be operated by compressed air, preferably obtained from the wall outlets of most hospital rooms, as well as with a foot pedal.

It is a still further object of the present invention to provide a hospital bed for the care of the critically ill patient having improved control during movement to the high supine, Fowler, Kneeflex, Trendelenburg, and reverse Trendelenburg positions.

It is a still further object of the present invention to provide a hospital bed for the care of the critically ill patient having bed frame support means which allows positioning of radiographic equipment below the entire length of the bed frame from either side thereof.

It is a still further object of the present invention to provide a hospital bed for the care of the critically ill patient having a positive release of the patient supporting frame from the Fowler position.

It is a still further object of the present invention to provide a hospital bed for the care of the critically ill patient having a readily locatable bidirectional X-ray cassette holder which may be attached to the patient supporting frame below any of the radiolucent panels affixed thereto to facilitate the taking of X-rays of a patient bidirectionally.

Other objects, aspects, and advantages of the present invention will be apparent from the following description and the drawings.

Briefly, the improved hospital bed for the care of the critically ill patient in accordance with the present invention includes a rigid rectangular bed frame, a segmented patient supporting frame mechanically coupled to the rigid rectangular bed frame and having a plurality of panels affixed thereto with the panels disposed transversely of the bed frame and intermediate the ends thereof, the panels being collectively proportioned so as to accommodate thereon inwardly of the inner perimeter of the bed frame a human patient in a fully prone position when the panels are arranged in a planar relationship, at least one of the panels being movable with respect to the remainder of the panels and with respect to the bed frame about an axis extending transversely of the bed frame, a support means for supporting the bed frame, hydraulic means coupled to the support means and to the patient supporting frame for raising the bed frame and at least one of the panels, and a dual mode pump means coupled to the hydraulic means for activating the hydraulic means in response to activation of a foot pedal coupled to the dual pump means or activation of a compressed air select pushbutton coupled to a source of compressed air. Preferably, the improved hospital bed includes a bidirectional spring loaded cassette holder for positioning an X-ray cassette below any of the radiolucent panels to facilitate the taking of X-rays.

A preferred embodiment of the present invention is illustrated in the accompanying drawings. However, it should be expressly understood that the present invention should not be limited solely to the preferred embodiment, which also includes various design refinements and details present in the commercial embodiment which are not considered to be part of the present invention per se. The drawings are as follows.

Figure 1:
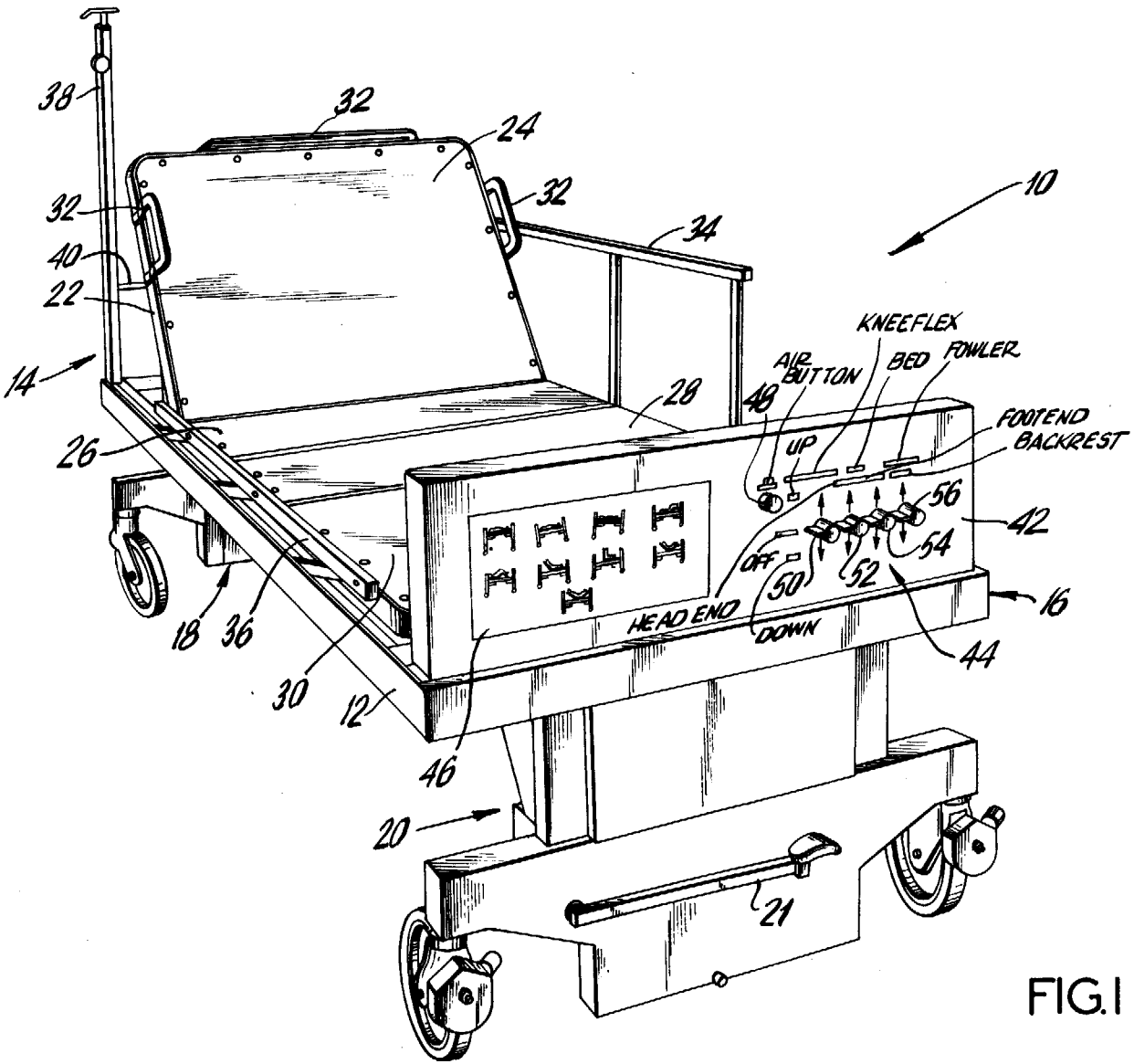
FIG. 1 is a perspective view illustrating the improved hospital bed of the present invention in the Fowler position.

Referring to FIG. 1, one embodiment of the improved hospital bed is illustrated at 10. The improved hospital bed 10 includes a rigid rectangular bed frame 12 supported at its head end 14 and foot end 16 by pedestal support means 18 and 20. Pivotally coupled to the pedestal support member 20 is a movable foot pedal 21 whose function and operation will be described in more detail below.

Mechanically coupled to the bed frame 12 is a segmented patient supporting frame 22. Fixedly coupled to the patient supporting frame 22 are four panels 24, 26, 28, and 30, preferably made of radiolucent material, such as phenolic resin impregnated fabric laminate. Thus, the segmented patient supporting frame 22 when viewed in plane preferably, is fully open inwardly of its inner perimeter. The first panel 24 supports the upper body, i.e., the head and back, of a patient(not shown) and is movable out of the horizontal plane normally formed by the panels 24, 26, 28, and 30 when the patient is in the supine position. The second panel 26 supports the buttocks of a patient and is stationary in the horizontal plane. The third panel 28 supports the thighs of a patient and is movable out of the horizontal plane. The fourth panel 30 supports the lower legs and feet and is movable out of the horizontal plane in conjunction with the third panel 28. The panels 24–30 are normally in a planar or horizontal position with one another in a plane parallel with the plane of the bed frame 12. Handles 32 are attached to the portion of the segmented patient supporting frame 22 to which panel 24 is affixed. The purpose of these handles 32 will be more fully explained with reference to FIG. 3.

Also affixed to the bed frame 12 are siderails 34 and 36 which are retractable into slots 37 (only one shown) in the bed frame 12, an intravenous extension rod 38, and headboard and footboard members 40 and 42, respectively. Advantageously, the siderails 34 and 36 and intravenous extension rod 38 are positioned between the outer perimeter of the segmented patient supporting frame and the outer perimeter of the bed frame. The footboard member 42 advantageously includes a control panel portion 44 and a diagrammatic portion 46 showing the various positions which the bed may take in accordance with the activation of the controls of the control panel portion 44.

The control panel portion 44 includes an air select pushbutton 48, and controls in the form of bed position control switches 50, 52, 54, and 56. Bed position control switch 50 controls the movement of the panels 28 and 30 to the Kneeflex and vascular positions. Position control switch 56 controls the movement of the panel 24 of the Fowler or semi-Fowler postions. Position control switch 52 controls the movement of the head end 14 of the bed frame 12 and position control switch 54 controls the movement of the foot end 16 of the bed frame 12.

It can be appreciated that with the aforementioned bed construction there is preferably an absence of any non-radiolucent material within the inner perimeter of the patient supporting frame 22 to enable X-raying and fluoroscoping of the patient in bed with mobile equipment without the necessity of moving the patient to the equipment. Moreover, the desired equipment may be readily positioned below the bed frame 12 with access from either side thereof.

Figure 2:
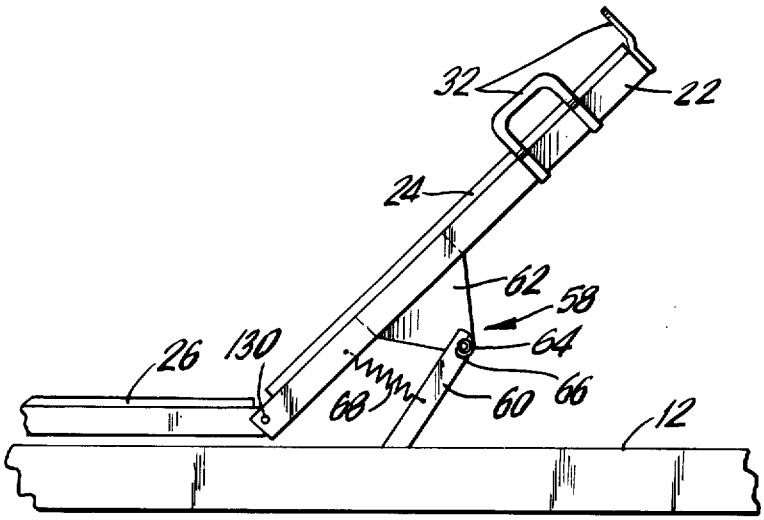
FIG. 2 is a side elevational view of a portion of the improved hospital bed in the Fowler position showing a quick release arm.

Referring to FIG. 2, when it is desired to place the patient in the Fowler position, i.e., panel 24 in a fully upward position, bed position control switch 56 is place in the up position, as shown in FIG. 1, and that portion of the segmented patient supporting frame 22 to which panel 24 is fixedly attached is pivoted upwardly relative to bed frame 12 by a hydraulically driven linkage 58. The hydraulically driven linkage 58 includes a movable arm 60 coupled to a Fowler bracket 62 through pin 64 affixed to the Fowler bracket 62, as shown in FIG. 2.

Advantageously, the upper end 66 of the movable arm 60 is shaped to engage the pin 64 and support the Fowler braclet 62 and therefore that portion of the segmented patient supporting frame 22 coupled to the panel 24. Additionally, a return spring 68 is coupled between the movable arm 60 and the patient supporting frame 22. With this construction, during cardiac arrest a patient may be quickly moved from the Fowler position to the supine position by pulling slightly upward and forward on one of the handles 32 enabling the Fowler bracket 62 and pin 64 to move out of engagement with the upper end 66 of the movable arm 60, thereby allowing movable arm 60 to retracted toward the patient supporting frame 22 by the return spring 68 and allow that portion of the segmented patient supporting frame 22 coupled to the panel 24 to immediately lower the patient to the supine position wherein resuscitative methods of cardiac-pulmonary resuscitation can be instituted. Thereafter, the upper end 66 of the movable arm 60 is repositioned in firm engagement with the pin 64 prior to subsequent movement of the patient supporting frame to the Fowler or semi-Fowler positions.

Figure 3:
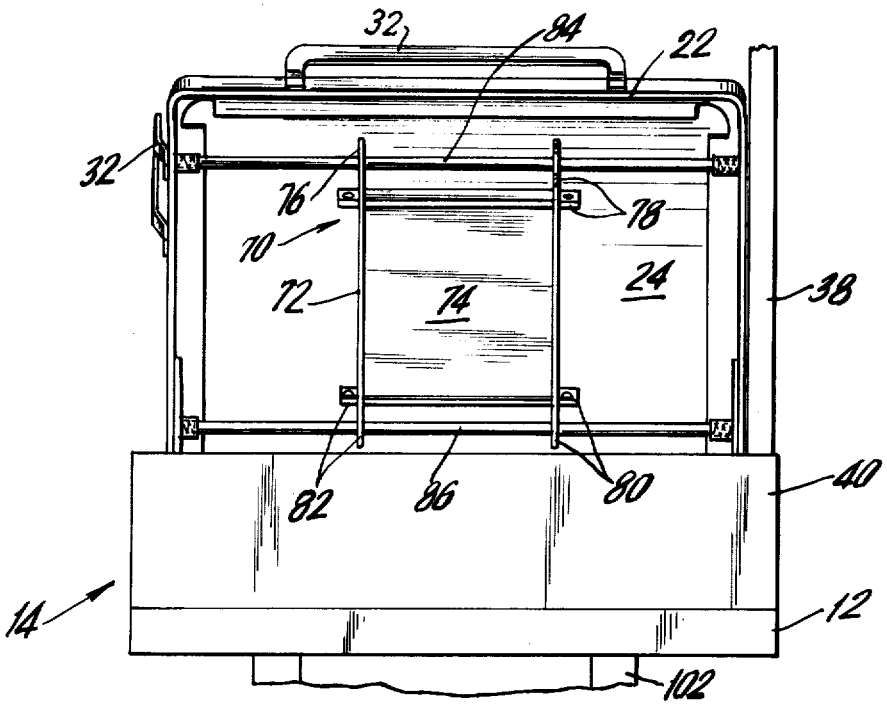
FIG. 3 is a rear view of FIG. 2 showing the bidirectional spring loaded cassette holder engaging the patient supporting frame below the upper body panel.

Referring to FIG. 3, with the panel 24 in the Fowler position as illustrated in FIG. 2 a bidirectional spring loaded X-ray cassette holder 70 is shown positioned in contact with the periphery of the inner sidewalls of the segmented patient supporting frame 22. The bidirectional spring loaded X-ray cassette holder 70 includes a rectangular portion 72 for receiving an X-ray cassette 74 and pairs of right angle corner extensions 76, 78, 80 and 82. Each one of the extenisons of each of right angle corner extension pairs 76, 78, 80 and 82, has a hole therein for receiving spring loaded rods 84 or 86. The spring loaded rods 84 and 86 are inserted through parallel corner extensions on opposite sides of the rectangular portion 74 so that the spring loaded rods 84 and 86 are parallel to each other. Specifically, as shown in FIG. 3, the spring loaded rod 84 is positioned through parallel corner extensions of pairs 76 and 78, and the spring loaded rod 86 is positioned through parallel corner extensions of pairs 80 and 82. If it is desired to change the orientation of the rectangular portion 72, e.g., for an obese patient, the rods 84 and 86 are removed and one rod, e.g., 84 is inserted in the parallel corner extensions of pairs 78 and 80 and the other rod, e.g., 86, is inserted in the parallel corner extensions of pairs 76 and 82.

Figure 4:
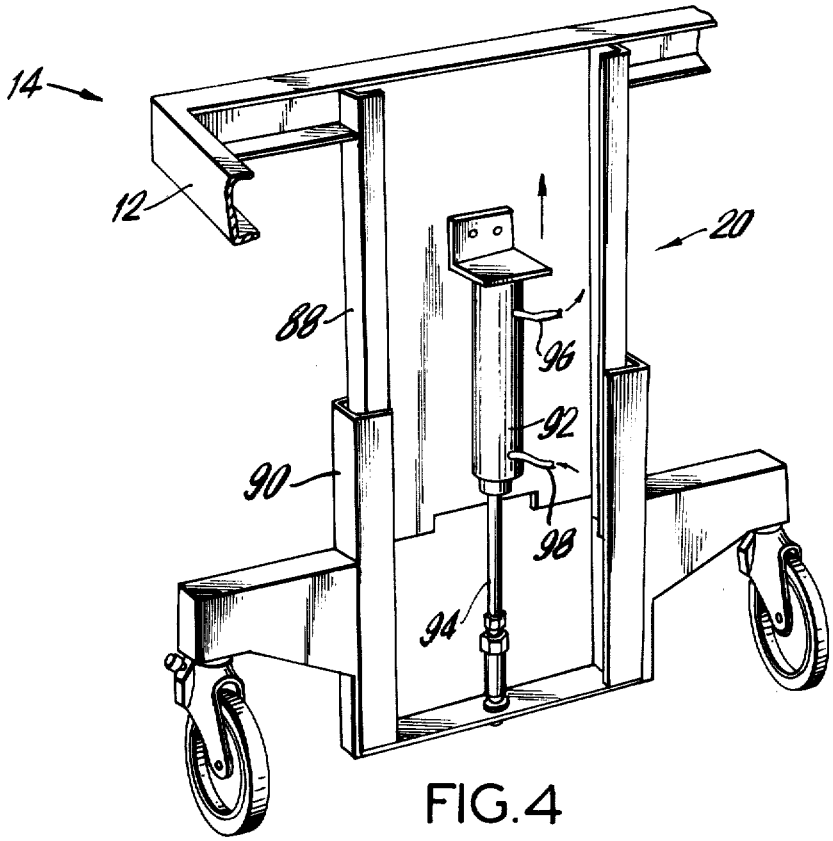
FIG. 4 is a partial perspective view of the pedestal support means and hydraulic means at the head end of the bed.

Referring to FIG. 4, the pedestal support means 18 for the head end 14 is shown with its cover plates removed for claritly. The pedestal support means 18 includes a central member 88 affixed to the bed frame 12 and depending therefrom, and a base member 90 for telescopingly receiving the central member 88. Fixedly coupled to the interior wall of the central member 88 is a conventional dual chamber hydraulic cylinder 92 having its cylinder piston rod 94 fixedly coupled to the base member 90. Entry of fluid, e.g., mineral oil, into the hydraulic cylinder 92 through the upper conduit 96 will push the hydraulic piston (not shown) downwardly causing the cylinder piston rod 94 to extend downwardly relative to the hydraulic cylinder 92 and thus provide upward movement of the central member 88 and the bed frame 12 affixed thereto relative to the base member 90. Entry of fluid into the hydraulic cylinder 92 through the lower conduit 96 pushes the hydraulic piston upward causing the cylinder piston rod 94 to retract within the hydraulic cylinder 92 and thus provide downward movement of the central member 88 and the bed frame 12 affixed thereto relative to the base member 90.

Figure 5:
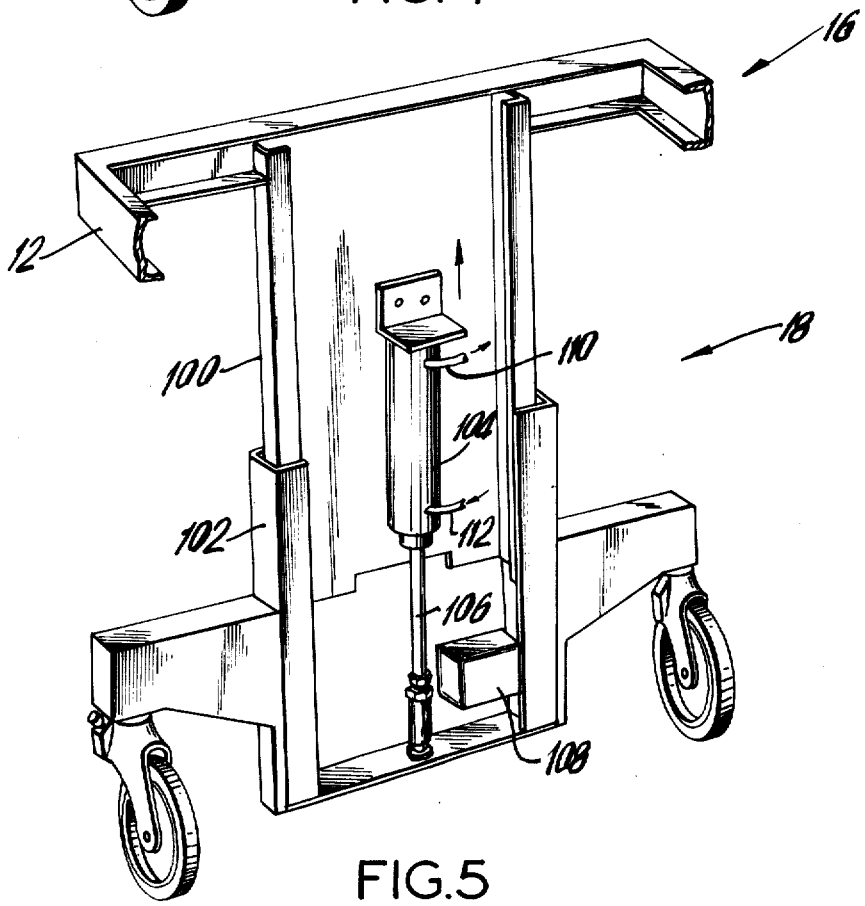
FIG. 5 is a partial perspective view of the pedestal support means and hydraulic means at the foot end of the bed.

Referring to FIG. 5, the pedestal support means 20 for the foot end 16 is shown with cover plates removed for clarity. Similarly to the operation of the pedestal support means 18, the pedestal support means 20 includes a central member 100 affixed to the bed frame 12 and depending therefrom, and a base member 102 for telescopingly receiving the central member 100. Fixedly coupled to the interior wall of the central member 100 is a conventional dual chamber hydraulic cylinder 104 having its cylinder piston rod 106 affixed to the base member 102. Entry of the fluid into the hydraulic cylinder 104 through the upper conduit 110 will push the hydraulic piston (not shown) downwardly causing the cylinder piston rod 106 to extend downwardly relative to the hydraulic cylinder 104 and thus provide upward movement of the central member 100 and the bed frame 12 affixed thereto relative to the base member 102. Entry of the fluid into the hydraulic cylinder 104 through the lower conduit 112 pushes the hydraulic piston upward cuasing yhe cylinder piston rod 106 to retract within the hydraulic cylinder 104 and thus provide downward movement of the central member 100 and the bed frame 12 affixed thereto relative to the base member 102. Advantageously, a dual mode hydraulic pump 108 is positioned adjacent the hydraulic cylinder 104 and affixed to a mounting bracket (not shown) which is affixed to the inner wall of the base member 102.

Figure 6:
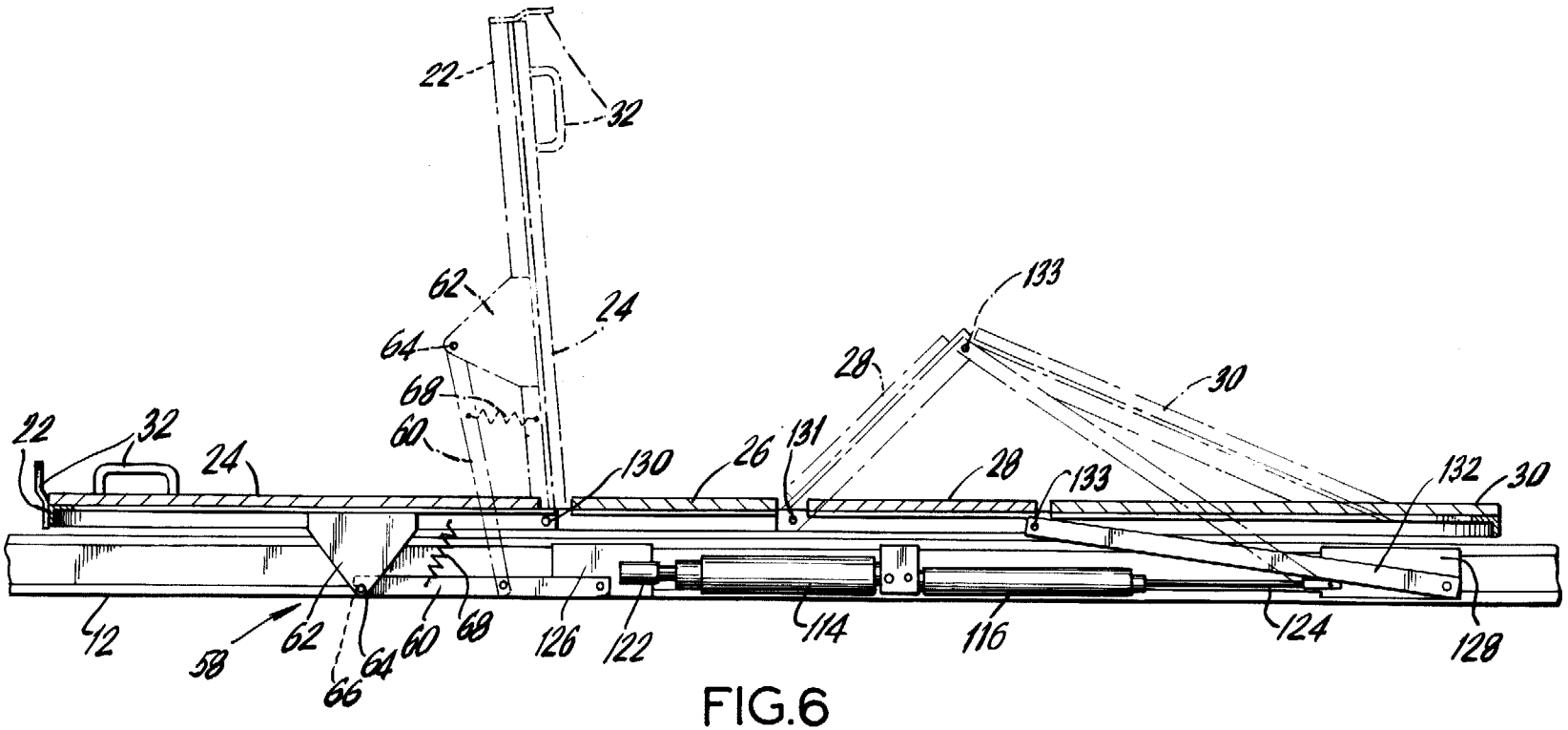
FIG. 6 is a partial side elevational view of one side of the bed frame showing the hydraulic means for moving the upper body panel and leg panels out of their horizontal planar position.

Referring to FIG. 6, a portion of the bed frame 12 is shown with additional hydraulic cylinders 114 and 116 for providing the Fowler and semi-Fowler, and Kneeflex and vascular positions, respectively. The hydraulic cylinders 114 and 116 are fixedly clamped to the bed frame 12. The free end of the cylinder piston rods 122 and 124 of cylinders 114 and 116, respectively, are coupled to slide members 126 and 128, respectively. Also pivotally coupled to the slide member 126 is the movable arm 60 which is linked to the Fowler bracket 62 as described with reference to FIG. 3. Thus, foward movement of the cylinder piston rod 122 of hydraulic cylinder 114 will cause the movable arm 60 to pivot relative to the slide member 126, thereby causing the portion of the segmented patient supporting frame 22 which supports panel 24 to pivot about a pair of pivots 130 (only one shown) to the Fowler position shown in dotted outline. Retraction of clyinder piston rod 122 will cause the movable arm 60 and panel 24 to return to the supine position as shown in FIG. 6.

An arm 132 is pivotally linked at one end to the slide member 128 and at its other end to the portion of the segmented patient supporting frame 22 affixed to the panel 28. Additionally, the portions of the patient supporting frame 22 below panels 28 and 30 are pivotally linked about a pair of pivots 133 (only one shown). Therefore, retraction of the cylinder piston rod 124 will cause rearward movement of the slide member 128, thereby pivoting the arm 132 about the slide member 128 and causing the other end of the arm 132 to pivot about one of the pivots 133 and move the portions of the patient supporting frame 22 which is affixed to panels 28 and 30 upwardly to the Kneeflex position shown in dotted outline in FIG. 6. Extension of the cylinder piston rod 124 will cause the arm 132 and panels 28 and 30 to return to the supine position shown in FIG. 6. The portion of the patient supporting frame 22 which supports panel 28 is affixed to the bed frame 12 with brackets (not shown) to maintain its horizontal position, but pivotally coupled at its ends to pivots 130 and 131 to enable the portions of the patient support frame 22 which support panels 24, and 28 and 30, respectively, to undergo pivotal movement relative to the panel 26.

Figure 7:
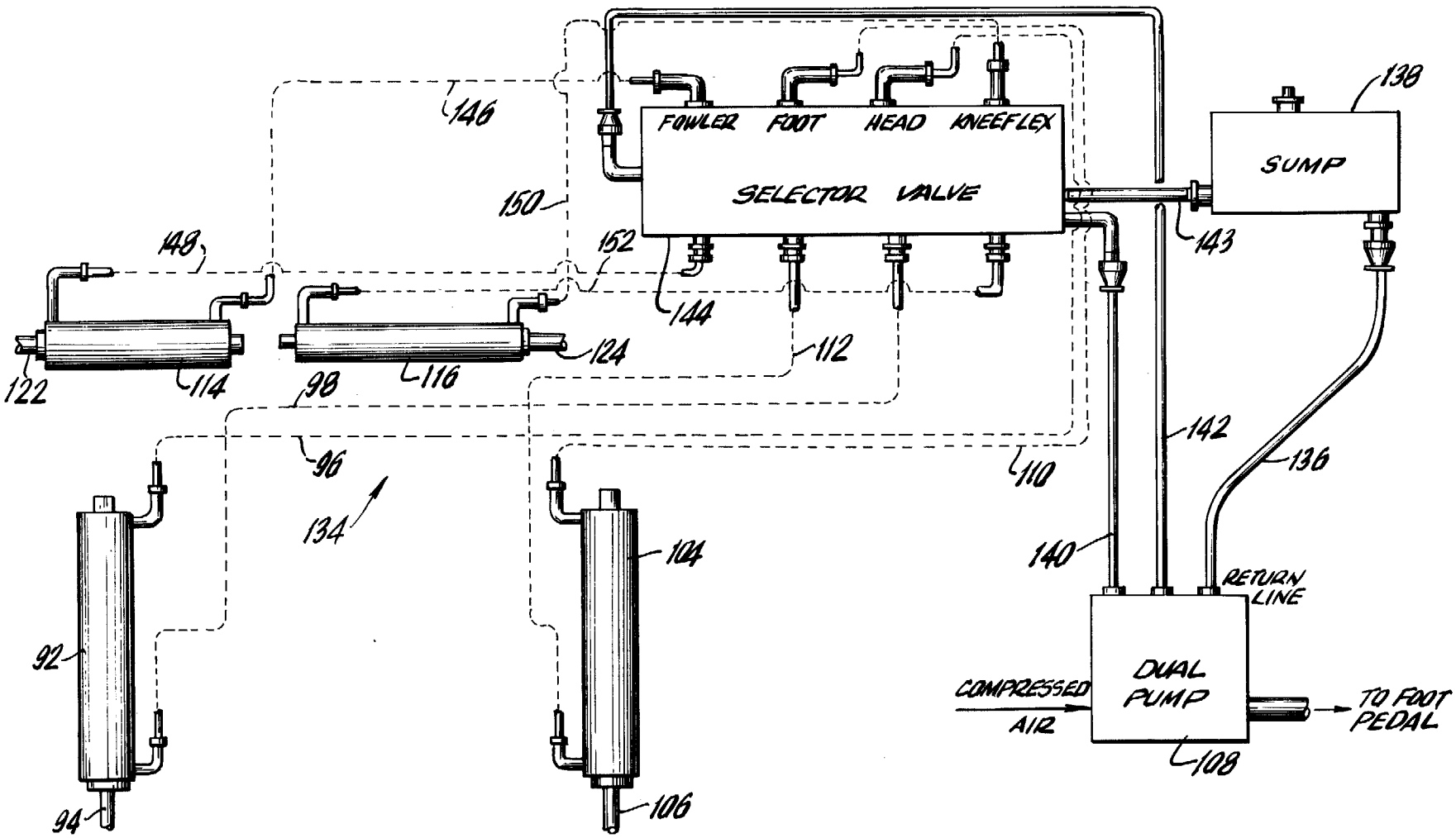
FIG. 7 is a schematic diagram of one form of hydraulic circuit for the improved hospital bed.

Referring to FIG. 7, one form of hydraulic circuit for use with the present invention is generally illustrated at 134. The hydraulic circuit 134 is powered via the dual mode pump 108. The dual mode pump 108 is driven by the foot pedal 21, see FIG. 1, or from a source of compessed air. The pump 108 has a suction line 136 coupledto a sump or fluid reservoir 138 and dual fluid lines 140 and 142 coupled to a conventional rotary directional selector valve 144 modified to include a by-pass capability. The selector valve 144 is preset by the position control valves 50–56. A fluid return line 143 is also coupled between the sump 138 and the selector valve 144. The dual mode pump 108 incudes two chambers for applying equal fluid pressure to the selector valve 144 through dual fluid lines 140 and 142 and therethrough to the hydraulic cylinders 92 and 194 which control the upward and downward movement of the head end 14 and foot end 16 of the bed frame 12. Thus, the dual fluid lines 140 and 142 and selector valve 144 provide equal fluid pressure to the cylinders 92 and 104 to provide even upward and downward movement of the bed regardless of the orientation or weight of the patient. However, should it be desired to orient the patient in a Trendelenburg or reverse Trendelenburg position, the fluid entering the selector valve 144 from one of the fluid lines 140 and 142 is bypassed and returned to the sump 138 so that only the head end 14 or foot end 16 raises. For the Trendelenburg position the fluid from fluid line 140 is bypassed in the selector valve 144 and returned to the sump 138 without activating the hydraulic cylinder 92. For the reverse Trendelenburg position the fluid from the fluid line 142 is bypassed in the selector valve 144 and returned to the sump 138 without activating the hydraulic cylinder 104.

Specifically, for the Trendelenburg position the bed control position switches 50, 52 and 56 are off and the bed control position switch 54 is on and fluid flows from the selector valve 144 through line 110 to extend the cylinder piston rod 106 of hydraulic cylinder 104 and raise the central member 100, thereby raising the foot end 16 of the bed frame 12 to an up position. Thus, the patient is canted with his feet above the level of his head. In the reverse Trendelenburg position the bed control position switch 52 is on and the bed control position switches 50, 54 and 56 are off and fluid flows from the selector valve 144 through line 96 to extend the cylinder piston rod 94 of hydraulic cylinder 92 and raise the central member 88, thereby raising the head end 14 of the bed frame 12 to an up position. Thus, the patient is canted with this head above the level of his feet.

The high supine position, which is the level patient position in which most X-ray and fluoroscopy procedures are performed, is attained by placing both bed control position switches 52 and 54 in the up position. With the bed control position switches 52 and 54 in this position, fluid pressure is applied equally from the selector valve 144 to the pistons of the hydraulic cylinders 92 and 104 through lines 110 and 96, respectively, to simultaneously and evenly raise the patient to the high supine position.

The patient is lowered from any of the aforementioned positions by turning the appropriate position control switches 52 and/or 54 to the down position allowing fluid to pressurize the hydraulic cylinders 92 and/or 104 through lines 98 and/or 112 to retract the cylinder piston rods 94 and/or 106. Thus, the patient is returned to the normal supine position. Pilot operated check valves (not shown) are mounted on the bed control position switches 52, 54 and 56, thus assuring that the bed cannot be accidentally lowered even if someone turns the switches 52, 54, and 56 to the down position. Positive action is required either through pumping the foot pedal 21 or holding the air pushbutton 48 depressed. This prevents the bed from falling and possibly damaging the radiographic equipment under the bed, and also prevents the patient with an indwelling endotracheal tube, from going on to the prone position from high Fowler, having the tube torn out and creating a life threatening situation. Thus, positive actuation of the foot pedal 21 or depression of the air pushbutton 48 must be accomplished after the selection of a particular position determination by setting the bed position control switches 50–56.

To place the patient in a semi-Fowler position, the position control valve 56 is placed in the up position and pressurized fluid flows from the selector valve 144 to the hydraulic cylinder 114 through fluid line 146 to extend the cylinder piston rod 122 and move the portion of the patient supporting frame 22 and affixed panel 24 upwardly. When the desired semi-Fowler position is attained, the position control switch 56 is turned to off position and the hydraulic cylinder 114 remains fluid pressurized and the portion of the patient supported frame 22 and panel 24 affixed thereto are locked in the semi-Fowler position. The Fowler position is attained in the same manner, but the bed position control switch 56 is not turned to the off position until the panel 24 has fully completed its upward movement, see the dotted outline in FIG. 6. To return the patient to the normal supine position from the semi-Fowler or Fowler positions, the bed position control switch 56 is turned to the down position and fluid is transmitted to the hydraulic cylinder 114 through fluid line 148 to lower the panel 24. To place the patient in the Kneeflex position, the bed position control valve 50 is placed in the up position and pressurized fluid flows through the fluid line 150 to transmit fluid to the hydraulic cylinder 116 and retract the cylinder pis'on rod 124 to raise the panels 28 and 30, to the Kneeflex position shown in dotted outline in FIG. 6. To return the panels 28 and 30 from the Kneeflex position to their normal horizontal position, bed position control valve 50 is placed in the down position and pressurized fluid flows through the fluid line 152 to extend the cylinder piston rod 124, thereby lowering the panels 28 and 30.

The vascular position is attained in a manner similar to the Kneeflex position, with a U-shaped foot riser bracket (not shown) pivotally coupled to the portion of the patient supporting frame 22 which supports panel 30 being placed in engagement with a pair of slotted locking plates (not shown) affixed to the bed frame 12. Thus, when bed position control switch 50 is in the on position, the panel 30 will assume a position generally parallel with the bed frame 12 in contrast with the canted position normally assumed by panel 30 when the bed position switch to is in the on position.

The cardiac position is a combination of the semi-Fowler position and the vascular position and is attained by utilizing bed position control switches 50 and 56. The high cardiac position is similar to the cardiac position, but the bed position control switch 50 is left in the on position until the panel 30 moves into alignment with panel 28.

Figure 8:
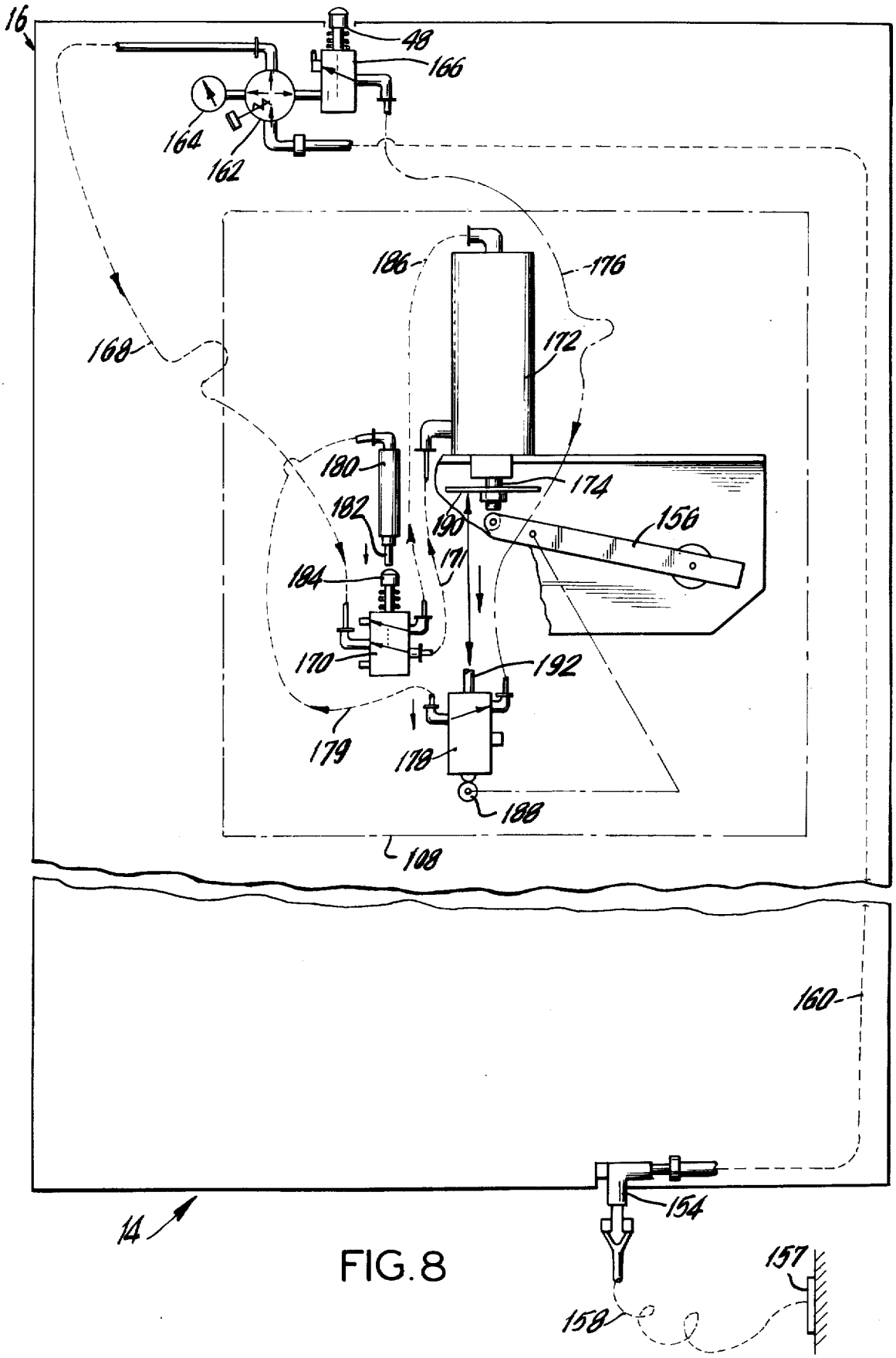
FIG. 8 is a schematic diagram of a portion of the dual mode pump showing the means for activating the pump with compressed air.

Referring to FIG. 8, the dual mode pump 108 is shown schematically with the air select pushbutton48 at the foot end 16 and a compressed air coupling 154 at the head end 14 of the bed frame.

The dual mode pump 108 has a pump crank arm 156 which drives a conventional dual chamber pump (not shown) for transmitting pressurized fluid from the pump 108 to the selector valve 144 through fluid lines 140 and 142, see FIG. 7. The dual mode pump 108 may be driven by the foot pedal 21 which is mechanically coupled to the pump crank arm 156 in a conventional manner. Alternatively, the pump 108 may be driven by a source of compressed air. Preferably, the source of compressed air is found in the wall outlet 157 of most hospital rooms. Alternatively, the air source may be a cylinder tank of compressed air. An air supply line 158 is coupled between the compressed air coupling 154 and the wall outlet 157. The compressed air is transmitted along the supply line 158 to the coupling 154 and from the coupling 154 along another air line 160 to a pressure regulator 162 which is set, e.g., at 40 PSI. A pressure gauge 164 is coupled to the pressure regulator 162 to monitor the pressure of the air exiting from the pressure regulator 162. If the air select pushbutton 48 has not been depressed, a pushbutton valve 166 coupled to the pressure regulator 162 is inoperative. The compressed air exiting from the pressure regulator 162 is transmitted along an air supply line 168 to a pilot valve 170 which transmits the compressed air to another air supply line 171 to the lower end of a power cylinder 172 to hold the piston (not shown) of the power cylinder 172 and therefore its piston rod 174 in a raised position, as shown in FIG. 8. In this position, the piston rod 174 of the power cylinder 172 is positively retracted and the pump 108 is inoperative unless the foot pedal 21 is pumped.

When the air pushbutton 48 is held depressed, position of the pushbutton valve 166 is altered and compressed air is transmitted along air supply line 176 to a shuttle valve 178. The shuttle valve 178 transmits air therethrough to air supply line 179 and to a pilot cylinder 180 positioned adjacent the pilot valve 170. The compressed air admitted to the pilot cylinder 180 drives its piston rod 182 downwardly so that the piston rod 182 engages a plunger 184 of the pilot valve 170 so that the air in the air supply line 171 is exhausted and the air from supply line 168 is coupled to air supply line 186. The compressed air in the air supply line 186 is transmitted to the upper end of the power cylinder 172 for moving the piston rod 174 downwardly to engage and pivot the pump crank arm 156. The pivotal movement of the pump crank arm 156 drives the pump which supplied fluid to the selector valve 144 via fluid lines 140 and 142. A reset roller 188 normally positioned below the shuttle valve 178 is also mechanically coupled to the pump crank arm 156. The reset roller 188 moves with the pump crank arm 156 as it is depressed by the piston rod 174 so that a plate 190 coupled to the piston rod 174 depresses the plunger 192 of the shuttle valve 178 when the piston rod 174 is in its fully downward position. Depression of the plunger 192 switches the shuttle valve 178 causing the air from the air supply line 170 to be exhausted thereby depressurizing the pilot cylinder 180 and allowing retraction of its piston rod 182 via a return spring (not shown). Retraction of the piston rod 182 switches the pilot valve 170 to the position shown in FIG. 8, so that the air supply line 186 is exhausted and air supply line 168 is coupled to air supply line 171 enabling the piston of the power cylinder 172 to be pushed upwardly, retracting the piston rod 174 to the position shown in FIG. 8. Thus, the piston rod 174 is positively retracted after each complete depression of the pump crank arm 156 to enable continuous upward and downward movement or cycling of the pump crank arm 156. (A return spring, not shown, is coupled to the piston rod 174 to maintain it in its retracted position once there, until the piston rod 174 is positively activated by fluid pressure.) Moreover, when the piston rod 174 is fully retracted the reset roller 188 returns to the position shown in FIG. 8 and resets the shuttle valve 178 to provide air pressure to the pilot cylinder 180 for repeating the cycle.

To operate the improved hospital bed 10, a nurse or other attendant sets the desired bed position control switches 50–56 in accordance with the desired position for an X-ray, fluoroscopy, of performing other medical procedures on a patient. However, prior to selecting the desired bed position control switches 50–56 to attain certain positions, e.g., vascular, cardiac, and high cardiac positions, the U-shaped bracket coupled to the patient supporting frame 22 is placed in engagement with a slotted locking plate. Thereafter, the selected position is attained by depressing the foot pedal 21 to drive the dual mode pump 108, or alternatively, if the coupling 154 has been coupled to an operative source of compressed air, the air pushbutton 48 is held depressed and the pump 108 is driven via compressed air as explained in accordance with FIG. 8. It should be understood that when the air pushbutton 48 is depressed the foot pedal 21 is automatically disengaged so that it does not articulate by itself. When the proper height and orientation of the panel or panels being moved in response to the setting of the bed position control switches 50–56 is attained, the switch or switches are turned to the "off" position. If the patient is in the Fowler position, the quick release arm 60 may be released, e.g., during cardiac arrest, as described with reference to FIG. 2. If an X-ray is to be taken the bidirectional spring loaded cassette holder 70 is manually clamped to the periphery of the inner surface of the patient supporting frame 22 below the desired panel or panels as described with reference to FIG. 3.

Advantageously, when the bed position control switches 50–56 are in the "off" position any prior fluid connection between the hydraulic cylinders 92, 104, 114, and 116 and the selector valve 144 is maintained but the selector valve 144 provides a bypass to the sump 138 of any fluid transmitted to the selector valve 144 so that the accidental actuation of the foot pedal 21 or depression of the air pushbutton 48 will not result in movement of the respective piston rods 94, 106, 122, and 124 of hydraulic cylinders 92, 104, 114, and 116, respectively. Since the hydraulic cylinders 92, 104, 114 and 116 maintain their pressurized condition prior to moving the bed position control switches 50–56 to the off position, a positive fluid locking in the desired position is provided.

Preferably, the entire hospital bed 10 is coated with a non-conductive material, e.g., Nylon-11, to eliminate any micro-shock and macro-shock hazards to the patient.

It should be understood by those skilled in the art that various modifications may be made in the present invention, without departing from the spirit and scope thereof as defined in the appended claims.

What is claimed is:

1. A hospital bed, comprising:

a rigid rectangular bed frame;

a segmented patient supporting frame coupled to said bed frame including a plurality of panels disposed transversely of said bed frame and intermediate the ends thereof, said panels being collectively proportioned so as to accommodate thereon a patient in a fully prone position when said panels are arranged in a planar relationship, at least one of said panels being movable with respect to the remainder of said panels and with respect to said bed frame about an axis extending transversely of said bed frame;

support means for supporting said bed frame;

hydraulic means coupled to said support means and to said patient supporting frame for raising said bed frame and at least some of said panels; and dual mode pump means coupled to said hydraulic means for actuating said hydraulic means, said pump means being operable in at least one mode by compressed air.

2. The hospital bed recited in claim 1, wherein:

said pump means is arranged to be coupled to a source of compressed air found in a wall outlet of a hospital room.

3. The hospital bed recited in claim 1, wherein:

said hydraulic means coupled to said patient supporting frame changes the planar position of at least one of said panels.

4. The hospital bed recited in claim 1, including:

a removable bidirectional spring loaded cassette holder dimensioned to receive an X-ray cassette for mounting on said patient supporting frame below any of said panels to facilitate the taking of X-rays of a patient.

5. The hospital bed recited in claim 1, wherein:

said segmented patient supporting frame when viewed in plan being fully open inwardly of its inner perimeter.

6. The hospital bed recited in claim 1, including:

siderails and intravenous extension rods coupled to the hospital bed and means positioning said siderails and intravenous extension rods between the outer perimeter of said segmented patient supporting frame and the outer perimeter of said bed frame.

7. The hospital bed recited in claim 1, wherein said panels are radiolucent.

8. A hospital bed as claimed in claim 7, wherein:

said bed frame when viewed in plan is fully open inwardly of its inner perimeter, and said hydraulic means and said dual mode pump means are arranged on said bed so that they do not substantially obstruct radiographic view through said segmented patient supporting frame.

9. The hospital bed recited in claim 1 wherein said pump means includes a foot pedal.

* * * * *